US006059217A

United States Patent [19]

Ludwig et al.

[11] Patent Number: 6,059,217

[45] Date of Patent: May 9, 2000

[54] WINDING APPARATUS FOR ENDLESS THREADS

[75] Inventors: Adrian Ludwig; Roland Schenk; Kurt Schefer, all of Winterthur, Switzerland

[73] Assignee: Maschinenfabrik Rieter AG, Winterthur, Switzerland

[21] Appl. No.: 09/217,237

[22] Filed: Dec. 21, 1998

[30] Foreign Application Priority Data

Jan. 23, 1998 [DE] Germany ..... 198 02 509

[51] Int. Cl.[7] ..... B65H 54/22

[52] U.S. Cl. ..... 242/474.5; 242/474.4; 242/474.6; 242/486; 242/486.4

[58] Field of Search ..... 242/474.5, 474.6, 242/474.4, 486, 486.4

[56] References Cited

U.S. PATENT DOCUMENTS

| | | | |
|---|---|---|---|
| 4,298,171 | 11/1981 | Fluckiger et al. | 242/474.6 |
| 4,487,374 | 12/1984 | Sugioka et al. | 242/474.5 |
| 4,552,313 | 11/1985 | Sasaki | 242/474.6 |
| 4,765,552 | 8/1988 | Sugioka et al. | 242/486 |
| 5,016,829 | 5/1991 | Schippers et al. | 242/474.6 |
| 5,100,072 | 3/1992 | Behrens et al. | 242/474.5 |
| 5,407,143 | 4/1995 | Nakai et al. | 242/474.5 |
| 5,558,286 | 9/1996 | Sugioka et al. | 242/474.5 |
| 5,797,551 | 8/1998 | Wirz et al. | 242/486 |
| 5,816,513 | 10/1998 | Spahlinger | 242/474.5 |

FOREIGN PATENT DOCUMENTS

| | | |
|---|---|---|
| 0015410 | 9/1980 | European Pat. Off. . |
| 1247112 | 8/1967 | Germany . |
| 2459990 | 6/1975 | Germany . |
| 7820682 | 11/1978 | Germany . |
| 2048416C3 | 11/1982 | Germany . |
| 4321111A1 | 1/1994 | Germany . |
| 4423491A1 | 1/1996 | Germany . |
| 19538480 C1 | 5/1997 | Germany . |
| 29706350 U1 | 7/1997 | Germany . |
| 8916288U1 | 7/1997 | Germany . |

OTHER PUBLICATIONS

German Search Report, Jul. 17, 1998.

Patent Abstracts of Japan, Oct. 17, 1995.

*Primary Examiner*—Donald P. Walsh
*Assistant Examiner*—Minh-Chau Pham
*Attorney, Agent, or Firm*—Dority & Manning, P.A.

[57] ABSTRACT

In a winding apparatus for endless threads with a revolving disc (6) in the periphery of which at least two clamping chucks (8, 10) are rotatably supported and with a friction roll (2) the shaft of which as well as the shaft (12) of the revolving disc (6) are mounted at fixed locations in a frame, a shaft each (4, 12) is connected to a first drive device (120), and with a second drive device (40) respectively. Each clamping chuck is provided with its own third drive device (80), and a fourth drive device (100) respectively. The contacting pressure between the friction roll (2) and a respective clamping chuck each can be adjusted as a function of the diameter of a thread package being built on a clamping chuck.

10 Claims, 2 Drawing Sheets

WINDING APPARATUS FOR ENDLESS THREADS

BACKGROUND OF THE INVENTION

The present invention concerns a winding apparatus for endless threads, and an operating method for such a winding apparatus.

Due to the increasing production rates of winding machines, and of winding apparatuses respectively, and of the machines applied in subsequent processes respectively, in so far as the individual requirements of the operator of a plant, more attention is to be paid to the structure of the package build. Package density, package shape, unwinding properties of the textile material in process, etc., are to be taken into account. This requirement is met using an apparatus according to the present invention.

SUMMARY

The present invention relates to a winding apparatus for endless threads or, more generally, textile material, with at least one clamping bobbin chuck or a roll for taking up a thread package and with a friction roll or a delivery roll pressed against the thread package for generating a contacting pressure between the friction roll and the clamping chuck, or the thread package respectively, with a control module connected to at least one data storage device and via control circuits and connected to a pressuring device generating a contacting pressure exerted between, e.g. the clamping bobbin chuck and the thread package being built up thereon and the roll. In the control device means are provided using which, based on data taken in from the data storage device, via the control circuit variable contacting pressure conditions can be generated as a function of the progress of the package build, or of the bobbin chuck respectively, in the pressuring device between the bobbin chuck and the roll.

A winding apparatus for endless threads is proposed with a revolving disc in the periphery of which at least two bobbin chucks are rotatably supported and with a friction roll the shaft of which, as well as another shaft of the revolving disc, is mounted in a frame and in which arrangement the other shaft is connected to a first drive device and the first mentioned shaft is connected to a second drive device, and in which each bobbin clamping chuck is provided with its own third drive device, and with a fourth drive device respectively. At least one of the drive devices mentioned consists of a programme controlled inverter and a drive motor supplied with current supplied by the inverter. The clamping bobbin chucks can be supported using a pivoting arm each on the revolving disc or can be fixedly mounted directly onto the revolving disc. Each bobbin chuck is pivotably mounted on the revolving disc and can be pivoted by a pivoting drive device if pivoting arms are provided. The clamping bobbin chucks are pivotable by means of setting motors. In the zone of the friction roll, at least one thread string-up device, a thread traversing device, a shifting device and/or a lift-off device are supported. For the friction roll, and auxiliary drive arrangement can be provided engaging the roll at its periphery or in particular at its shaft. To the thread traversing device, preferentially a control arrangement is coordinated comprising a programme module for generating a stepped precision winding structure. For adapting the position of a shifting device a double action cylinder can be applied. The shaft of the friction roll and the other shaft of the revolving disc, or in more general terms, of the rotatable support member, can be arranged fixedly with respect to the surrounding room.

To a second drive device of the friction roll and to a third, or a fourth respectively, drive device of the bobbin clamping chucks, a common control device must be superordinated. Preferentially, this permits programmed variation of the load distribution between the second and the third or fourth drive device. Otherwise, however, the drive devices mentioned must be controlled as to their rotational speeds in such a manner that the circumferential speeds of the friction roll and of a thread package do not differ substantially.

In the winding zone of a bobbin clamping chuck, an entangling see-saw device can be provided comprising a spring and an air nozzle which can be pressed against a thread package, the air nozzle in this zone serving for delaying the formation of an end bulge on the thread package. In the frame of the winding apparatus, a thread package lifting device is provided which facilitates the exchange, and the removal respectively, of the completed thread packages. Preferentially, a blocking device provided for the thread package lifting device is activated over certain operating phases. On the thread string-up device, if required, a thread severing device with a severing protrusion for thread ends is provided. For the thread traversing device a lubrication system can be provided. As the main control device of the winding apparatus is started up, preferentially at least a third drive device or a fourth drive device of the bobbin chuck currently concerned are started up also in such a manner that upon operation of a thread string-up device after the start-up of the machine the thread can be transferred without delay onto a package tube on a bobbin chuck.

As individual drives are provided for the friction roll and the contacting roll, as well as for the clamping chucks or bobbin chucks, particularly gently handling of the thread can be achieved especially during the process of thread transfer from one thread package to the subsequent one in such a manner that no relative movements between the thread and the surfaces of the thread packages or the rolls contacting the thread have to be incurred.

The drive devices for the shifting of the clamping chucks relative to the revolving disc or the revolver on one hand, and for the revolver on the other hand, render feasible that the package change process can be effected independently of the winding start-up of the new thread package, and vice-versa respectively.

The present invention is described in more detail in the following with reference to illustrated design examples.

DETAILED DESCRIPTION

Figure 1:
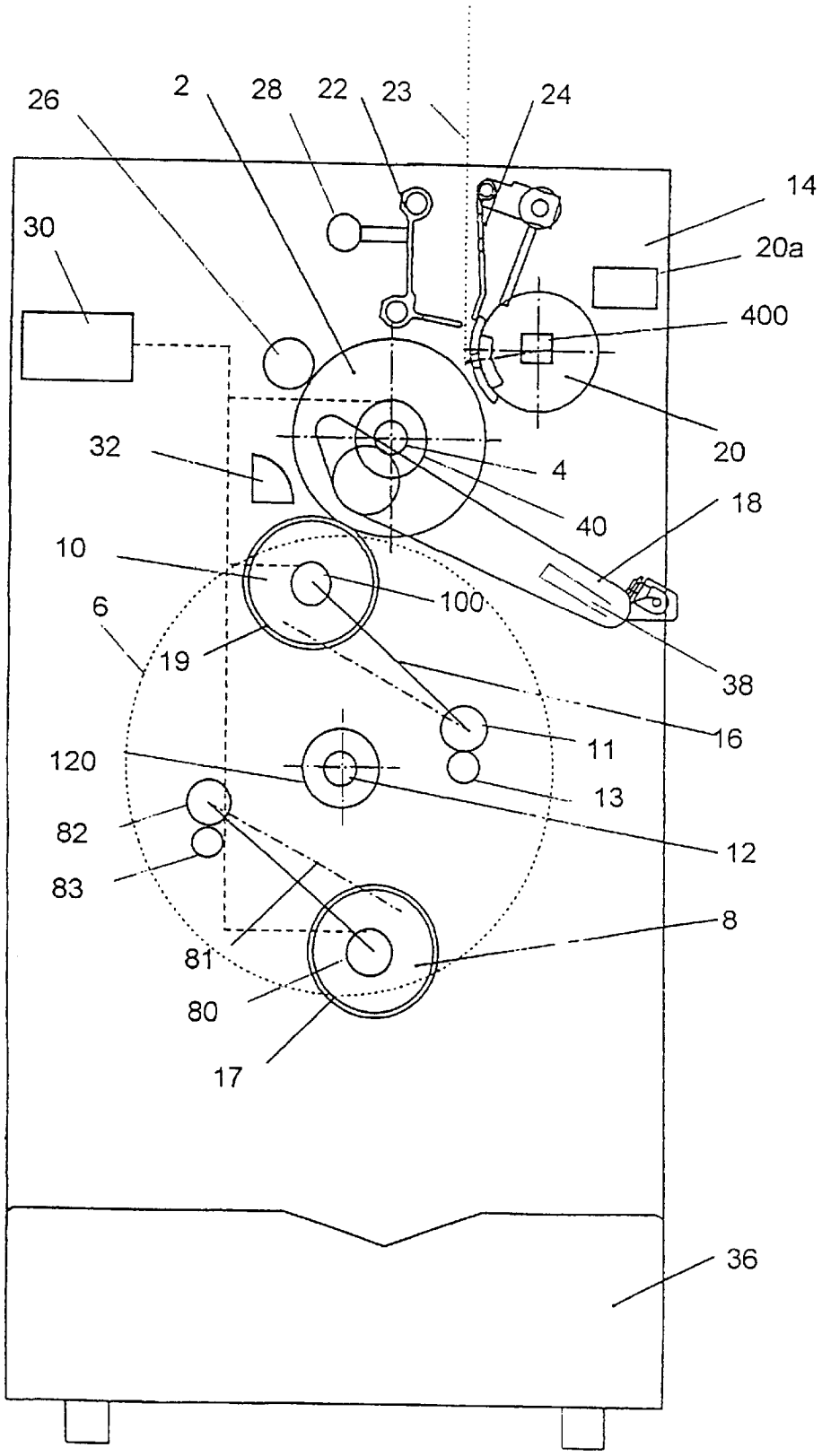
FIG. 1 An overall view of the most important components of the apparatus, and in the FIG. 2 A control device for the contacting pressure between a bobbin chuck and the friction roll.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

A thread 23 is supplied from above into the zone of the frame 14 of a spinning device to between a thread shifting device 22 and a thread traversing device 20 on which a lift-off device 24 for the thread can be arranged. The thread 23, indicated with broken lines, upon leaving the traversing device 20 is deflected about the lower right hand portion of the circumference of a friction roll 2 into the direction of a clamping chuck 10 with a package tube 19 placed on it. At the start-up of a winding cycle, i.e. as soon as a freshly spun or a treated thread 23 is supplied a thread string-up device 18 is activated which takes over the thread 23 above the frame 14 and places it onto the circumference of a package tube 19.

In addition to the first clamping bobbin chuck 10 with a package tube 19, a second clamping bobbin chuck 8 is provided with a package tube 17, both chucks being supported on a revolver disc 6 which via a shaft 12 is connected to a first drive device 120. The revolver disc 6 and the first drive 120 are in motion each time while the positions of the first chuck 10 and of the second chuck are exchanged and during a part of the thread package build-up. The bobbin chucks 10 and 8 can be arranged rotatably directly on the revolving disc 6 or can be arranged pivotably on the revolving disc 6 via pivoting arms 81 and 16.

As soon as the thread 23 is connected to the package tube 19, the actual winding process can be started. For driving the friction roll 2, also called tacho roll, a shaft 4 is used with a second drive device 40. For driving the chuck 8, and 10 respectively, a third drive device 80, and a fourth drive device 100 respectively, are mounted onto the revolver disc 6. If pivoting arms 81, and 16 respectively, are used, a pivoting drive device 82 with a setting motor 83, and a second pivoting drive device 11 with a setting motor 13 respectively, are required for adjusting the position of the pivoting arms.

For driving rotating rolls, such as e.g. the clamping chuck 8 or the friction roll 2, preferentially asynchronous motors are used which are supplied with alternating current of adjustable frequency. The other setting motors, e.g. the first drive device 120 for rotating the revolver disc 6 or the setting motors 83 and 13 can be mechanical or pneumatic or electromechanical setting motors.

In the lower portion of the frame 14, a thread package lifting device 36 is arranged using which completely wound packages pivoted down with their respective package tubes 17 and 19 can be removed from the winding apparatus.

To the thread traversing device 20 a control device 20*a* can be coordinated which comprises a programme module for generating a stepped precision winding process. A double action cylinder 28 can be provided for adjusting a shifting device 22. To a second drive device 40 of the friction roll 2 and to a third drive device 80 of the chuck 8 as well as to a fourth drive device 100 of the chuck 10, a common main control device 30, as indicated in the FIG. 1, is superordinated using which the load distribution between the second drive device 40 and the third drive device 80 or the fourth drive device 100 can be varied according to a programme.

In the winding zone of a bobbin chuck 8 or 10 an entangling see-saw device 32 (shown schematically) can be pressed by means of a spring against a thread package placed on a chuck 8 or 10; furthermore an air nozzle (not shown) can be provided in this zone for delaying the formation of the end bulge. In the frame 14 a blocking device can be coordinated to the thread package lifting device 36. On the thread string-up device 18 a thread severing device 38, shown schematically, can be applied for severing thread ends dangling out. The thread traversing device 20 advantageously is provided with a traversing device lubricating system 400.

Figure 2:
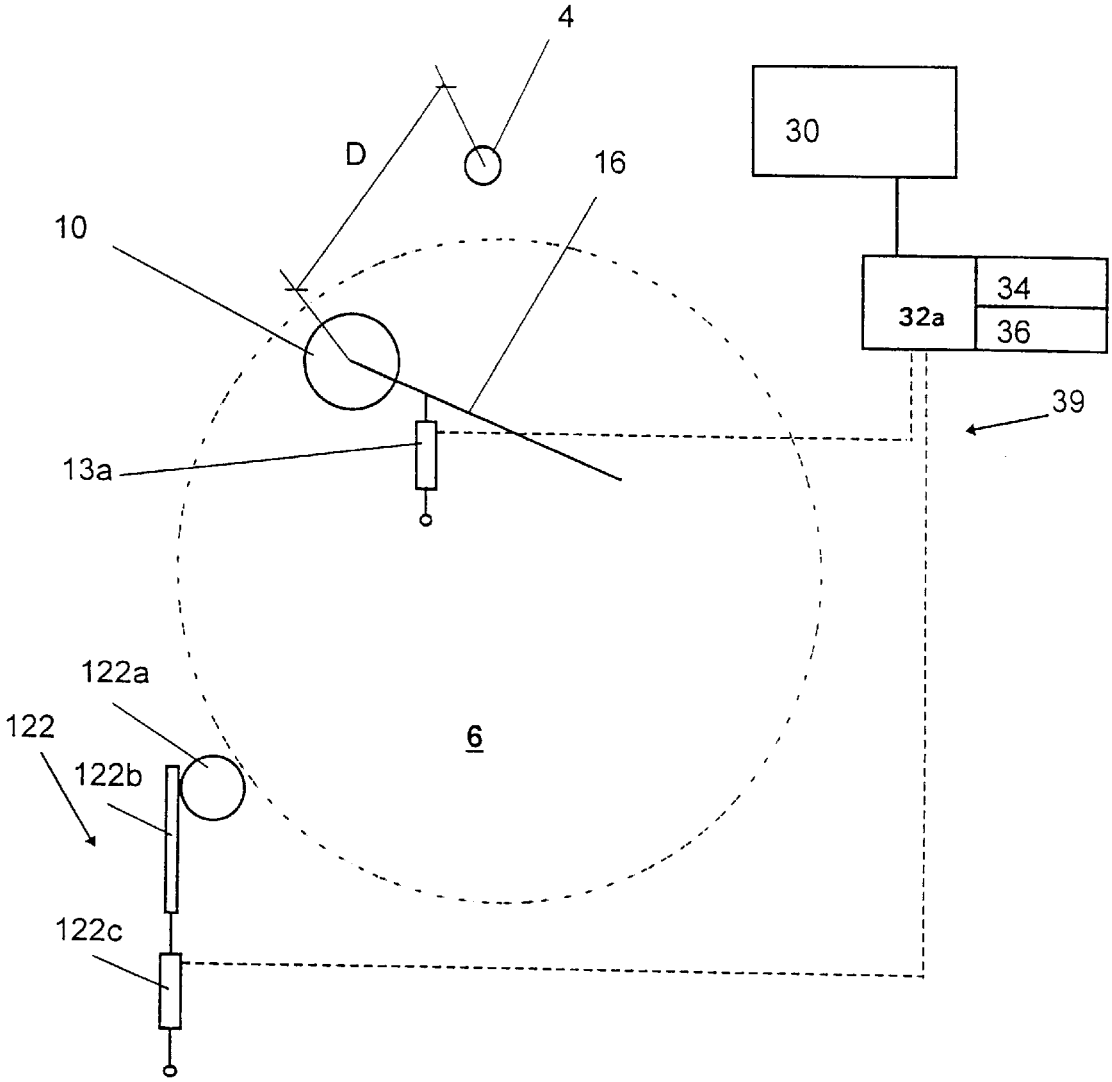

Maintaining constant, or varying, the contacting pressure between the friction roll 2 and the respective thread package coordinated to it, the distance between the respective axles in the FIG. 2 being designated D, presents a special problem. After the revolver disc 6 is rotated over 180° upon completion of a thread package each time, a thread 23, or a plurality of threads respectively, are wound onto the subsequent chuck with the package tube 19 placed on it. It has proven advantageous that during the build-up of a new thread package on a chuck 8 the contacting pressure between the thread layers on the chuck and the friction roll 2 or tacho roll be controlled. It proves feasible to maintain the contacting pressure constant or, respectively, to vary it according to a predetermined programme. This can be achieved in that the chuck 10 is pressed against the friction roll 2 by a pressing device. This can be effected in that a clockwise-torque momentum is exerted onto the revolver disc 6 or that while the revolver disc 6 is blocked the chuck 10, which in this case is to be supported shiftable relative to the revolver disc 6, is pressed against the friction roll 2 or tacho roll by another pressing device arranged between the revolving disc 6 and a pivoting arm 16, 81. For the friction roll 2 an auxiliary drive 26 can be provided.

In a preferred embodiment, the winding apparatus for endless threads according to the FIG. 2 is provided with a pressing mechanism (which may be formed from a combination of elements including 30, 32, 34, 36, 13*a*, 122) controlled according to a programme for generating a contacting pressure between a friction roll 2 and a clamping chuck 8, 10, with a control module 32*a* which is connected with at least one data storage device 34, 36 and via control circuits 39 is connected to a pressure device 122, 13*a* which exerts a torque momentum onto the revolver disc 6 in which The pressing devices 122, 13*a* may be provided with load-limiting setting motors, in particular pneumatic cylinders such as 122*c*.

The pressing device 13*a*, 122 is formed to be connected to a pivoting arm 16 of a clamping chuck 10 and/or directly to the revolving disc 6 in which case a setting motor 122*c* is connected to the revolving disc 6 via a rack 122*b* and a pinion 122*a*. arrangement in the control module 32*a* means are provided using which, based on data taken over from the data storage devices 34, 36, via the control circuits 39 in the pressing device 122, 13*a*, variable pressure conditions can be generated between a clamping chuck and the friction roll 2 independent of the state of progress of the winding cycle on a chuck 8, 10.

The pressing mechanism can be subdivided in a first pressing device 13*a* acting on a clamping chuck 8, 10 shiftably supported in the revolving disc 6 and/or a second pressing device 122 acting directly upon the revolver disc 6.

The contacting pressure between the friction roll 2 and a clamping chuck 8, 10 with a package tube 17, 19 placed thereon and a wound thread preferentially is varied at least temporarily as a function of the thread package diameter being built on the package tube 17, 19. Expressed in other words, the contacting pressure is varied as a function of the position of the pivoting arm 16 relative to the revolving disc 6 while the revolving disc is at a standstill; when a thread package being wound on a chuck has reached a diameter at which the pivoting arm 16 has reached a position nearest to the centre of the revolving disc 6, the contacting pressure is varied as a function of the position of the revolving disc 6. The position of the revolving disc 6 preferentially is scanned using a potentiometer in which arrangement the output of the potentiometer via a control module 32*a* is connected to a drive means of the pressing device for the revolving disc.

In the control module 32*a*, among others, a first programme is stored using which the correlation between the diameter of a package on a chuck 18 and a position of a pivoting arm 16 and/or a revolving disc 6, on which the chucks are supported, is established. Thus the angle of rotation a is expressed as a function of the diameter d of a thread package being wound according to the following relation:

$$a=f(d)$$

In a data storage device 36, for certain package diameters d of the thread package being built on the chucks 8, 10, the desired values of the contacting pressure P between the friction roll 2 and a clamping chuck 8, 10 are stored as corner data. Using a second programme in the control module 32*a*, intermediate desired values of the contacting pressure P between the corner data of contacting pressure values can be calculated according to the following function:

$$P=f(d)$$

After determination of the correlation between the position of a pivoting arm 16, 81 and/or the position of the revolving disc 6, or the diameter d of a package on a chuck 8, 10 respectively, and the corresponding value of the contacting pressure P, a pressing device 122 for the revolving disc 6 or a pivoting arm drive device 11 for a pivoting arm 16 of a clamping chuck 10 is controlled via a control module 32*a* in such a manner that the contacting pressure P required between the friction roll 2 and a package being built on a chuck 8, 10, in particular by pressurising a pneumatic cylinder, is adjusted in such a manner that the resulting relation between the contacting pressure P and the package diameter d is established according to the following general expression:

$$P=f(d)$$

The contacting pressure P can be measured in a bearing of the friction roll 2 using a force measuring device if a regulating device is provided for adjusting the contacting pressure to the respective predetermined desired value. In analogy to the variation of the contacting pressure, the traversing speed, or the traversing angle respectively, of the thread 23 can be varied in that between corner values for predetermined thread traversing angles as a function of the thread package build on a clamping chuck 8, 10, desired values of the traversing angle of the thread 23 are calculated. The thread traversing device is to be controlled in such a manner that the thread traversing speed of the thread for realising the desired thread traversing angle on a thread package being built on the clamping chuck is varied according to the values predetermined in the control module 32*a*.

It should be appreciated by those skilled in the art that various modifications and variations can be made in the present invention without departing from the scope and spirit of the invention. It is intended that the present invention include such modifications and variations as come within the scope of the appended claims and their equivalents.

| List of Items referred to in the FIGS. | |
|---|---|
| 2 | friction roll (tacho roll) |
| 4 | shaft |

-continued

| List of Items referred to in the FIGS. | |
|---|---|
| 6 | revolving disc |
| 8 | second clamping chuck |
| 10 | clamping bobbin chuck |
| 11 | pivoting drive device |
| 12 | shaft |
| 13 | setting motor |
| 14 | frame |
| 16 | pivoting arm |
| 17 | package tube |
| 18 | thread string-up device |
| 19 | package tube |
| 20 | thread traversing device |
| 20a | |
| 21 | |
| 22 | shifting device |
| 23 | thread |
| 24 | tread lift-off device |
| 26 | auxiliary drive device |
| 30 | |
| 32a | |
| 36 | thread package lifting device |
| 38 | thread severing device |
| 40 | second drive device |
| 80 | third drive device |
| 81 | second pivoting arm |
| 40,82 | pivoting drive device |
| 83 | setting motor |
| 100 | fourth drive device |
| 120 | first drive device |
| 122a | pinion |
| 122b | rack |
| 122c | setting motor |
| 400 | thread traversing lubricating system |

What is claimed is:

1. A winding apparatus for winding endless threads, comprising:

a revolving disc;

at least one clamping chuck rotatably supported on said revolving disc, said clamping chuck pivotal relative to said revolving disc and connected to a pivoting drive device;

a friction roll disposed so as to contact a thread package formed on said clamping chuck;

a controllable first pressing device configured to act on a pivoting arm of said clamping chuck and a controllable second pressing device configured to act on and impart a torque to said revolving disc, said pressing devices generating a contacting pressure between said friction roll and said thread package;

a control device operably configured with said first and second pressing devices to control the contacting pressure of said first and second pressing devices as a function of a diameter of said thread package being formed on said clamping chuck.

2. The apparatus as in claim 1, wherein said control device further comprises a data storage device having values of contacting pressures stored therein correlating to various diameters of a thread package, said control device controlling said first and second pressing devices according to said stored values.

3. The apparatus as in claim 1, wherein said revolving disc includes a disc shaft mounted at a fixed location within a machine frame, said disc shaft connected to a first drive device, and further comprising at two said clamping chucks rotatably supported on a periphery of said revolving disc, said friction roll having a friction roll shaft mounted at a fixed location within said machine frame, said friction roll shaft connected to a second drive device, and wherein each of said clamping chucks is connected to their own respective drive devices.

4. The apparatus as in claim 3, wherein at least one of said first drive device, second drive device, and clamping chuck drive devices comprises an electric motor supplied with current by a program controlled inverter.

5. The apparatus as in claim 3, wherein said clamping chucks are supported on said revolving disc by pivoting arms connected to pivoting drive devices.

6. The apparatus as in claim 3, further comprising a thread traversing device disposed proximate to said friction roll, said thread traversing device connected to a program control device for generating a stepped winding structure.

7. The apparatus as in claim 3, wherein said second drive device and said clamping chuck drive devices are connected to a common main control device such that load distribution therebetween can be varied by said common main control device.

8. The apparatus as in claim 1, wherein said pressing devices are configured with load limited setting motors.

9. The apparatus as in claim 1, wherein said second pressing device is configured with a rack and pinion drive element.

10. The apparatus as in claim 1, wherein said control device includes a program control module that controls said pressing devices in accordance with a control program that correlates sensed thread package diameters with desired contacting pressures.

* * * * *